US005271562A

United States Patent [19]

Myers et al.

[11] Patent Number: 5,271,562

[45] Date of Patent: Dec. 21, 1993

[54] DUAL FLUID ATOMIZER EXIT ORIFICE SHIELD GAS SUPPLY HOUSING

[75] Inventors: Robert B. Myers, Copley Township, Summit County; David R. Burley, Akron; Barbara J. Gray, Canal Fulton; Dennis W. Johnson, Barberton, all of Ohio

[73] Assignee: The Babcock & Wilcox Company, New Orleans, La.

[21] Appl. No.: 24,030

[22] Filed: Mar. 1, 1993

[51] Int. Cl.[5] ..... B05B 7/06

[52] U.S. Cl. ..... 239/290; 239/424; 239/549; 239/591

[58] Field of Search ..... 239/290, 296, 423, 424, 239/424.5, 548, 549, 591

[56] References Cited

U.S. PATENT DOCUMENTS

| | | | |
|---|---|---|---|
| Re. 32,064 | 1/1986 | Nielsen | 239/591 |
| 3,169,161 | 2/1965 | Kurzinski | 239/548 |
| 4,518,120 | 5/1985 | Johnson | 239/424 |
| 5,176,325 | 1/1993 | Vidusek | 239/591 |

FOREIGN PATENT DOCUMENTS

| | | | |
|---|---|---|---|
| 1460927 | 12/1966 | France | 239/424 |
| 0083110 | 5/1983 | Japan | 239/424 |
| 0198612 | 11/1983 | Japan | 239/424 |

*Primary Examiner*—Karen B. Merritt

*Attorney, Agent, or Firm*—Robert J. Edwards; Michael L. Hoelter

[57] ABSTRACT

An atomizer used in boilers, furnaces, downstream contaminant removal processes and the like, to atomize the oil/liquid/slurry product being sprayed into such enclosures. This particular atomizer is configured with individual openings around each exit orifice in the atomizer such that a shield gas (normally air) in communication with these openings, is ejected from the atomizer fully surrounding the spray emitted from each exit orifice.

9 Claims, 4 Drawing Sheets

DUAL FLUID ATOMIZER EXIT ORIFICE SHIELD GAS SUPPLY HOUSING

FIELD OF THE INVENTION

This invention pertains to atomizers that are used in boilers, furnaces and downstream contaminant removal processes and more particularly to a shield gas supply housing for such atomizers.

BACKGROUND OF THE INVENTION

In oil fired boilers, furnaces and the like, atomizers are commonly used to disperse the oil as a fine mist into the combustion chamber prior to firing. These atomizers serve the purpose of exposing as much oil particle surface as possible for contact with the combustion air in order to insure prompt ignition and burning.

Additionally, atomizers are used in downstream contaminant removal processes. For example, in a dry or semi-dry flue gas desulfurization process, a liquid or slurry reagent and/or recycle by-product is sprayed onto the incoming flue gas to remove sulfur or other contaminants before the flue gas is released to the atmosphere. In such a process, the liquid or slurry or reagent and/or recycle by-product is atomized for greater contact between the sprayed product and the contaminant to be removed.

Several methods of atomizing currently exist; some use steam or air to atomize while others use mechanical means to achieve the desired result. Steam or air atomizers operate on the principle of producing a steam-fuel (or an air-fuel) emulsion which, when released into the combustion chamber, atomizes the oil through the rapid expansion of the steam or air. Mechanical atomizers operate by using the pressure of the fuel itself as the means of atomization. While some mechanical atomizers have moving parts close to the furnace opening, these have generally lost favor due to their higher maintenance needs.

Despite the type used, it has been found desirable to surround the atomized mist (whether it be oil used in furnaces or boilers or a slurry of reagent and/or recycle by-product used in downstream contaminant removal processes) with a shield gas (normally air) as this mist enters the furnace or scrubber enclosure. In furnaces, this shield gas insures a local source of combustion air. In both furnaces and downstream contaminant removal processes, the shield gas maintains (or shields) the spray so that its direction will not be interrupted or deflected due to the currents within the furnace or scrubber vessel enclosure. Additionally, the shield gas minimizes or prevents any deposit of the liquid/solids emitted by the atomizer from developing on the surface of the atomizer head.

In the past, such shield gas was supplied by positioning the atomizer head concentrically inside a conduit thereby creating an annular flow area around this head which directed the shield gas to the tip of the atomizer head. While this method would seem to function sufficiently, it provides a single relatively large annular gas flow path that surrounds the entire atomizer head rather than the individual exit orifices on the atomizer head. Thus, while the outer exit orifices on the periphery of the atomizer head will have immediate access to the surrounding shield gas, the interior exit orifices will not be so fortunate since they are located some distance from this shield gas. Additionally, should the atomizer head be configured solely with outer exit orifices, the above arrangement would still only supply shield gas around the outer region of the spray coming from the atomizer head, it would not surround each individual spray from each individual exit orifice.

It is thus an object of this invention to provide a supply of shield gas that will surround each exit orifice of the atomizer head. Another object of this invention is to provide such shield gas in such a manner that it is equally dispersed among the various exit orifices such that no one orifice receives a greater supply of shield gas than another. Yet another object of this invention is to provide individual supplies of shield gas around the circumference of the individual exit orifices. These and other objects and advantages of this invention will become obvious upon further investigation.

SUMMARY OF THE INVENTION

What is disclosed is an atomizer for use in furnaces, boilers, or downstream contaminant removal processes that has an end cap assembly with at least one exit orifice therein and a shield gas supply housing spaced from the end cap assembly. The gap or space between this housing and the end cap assembly thereby defining a shield gas flow path. The improvement consists of individual openings surrounding each exit orifice with each such opening being in communication with the shield gas flow path whereby shield gas is ejected from the atomizer fully around the perimeter of each of the individual exit orifices.

DETAILED DESCRIPTION OF THE DRAWINGS

Figure 1:
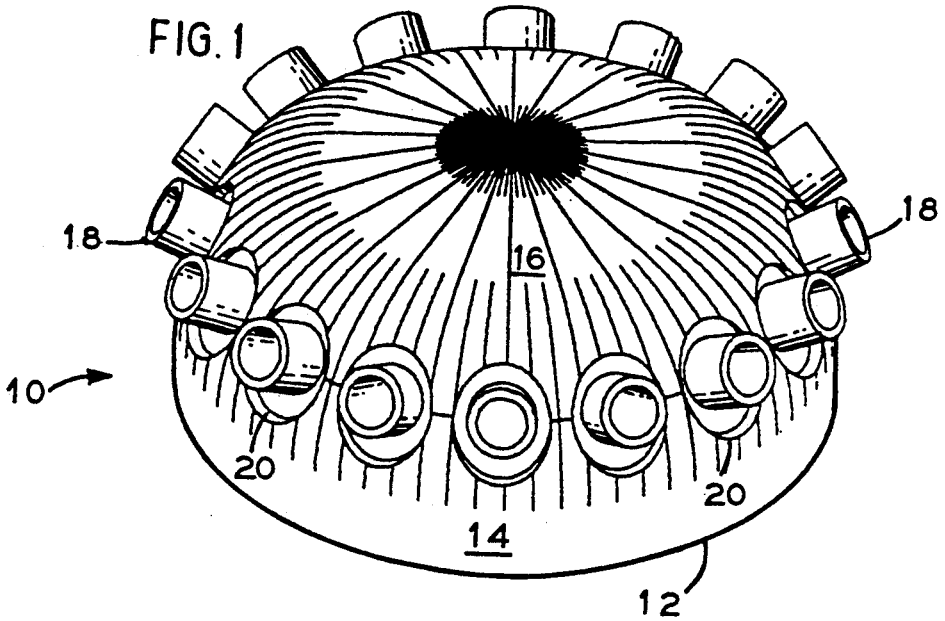
FIG. 1 is an isometric view of the invention illustrating the numerous exit orifices of the atomizer head.
Figure 2:
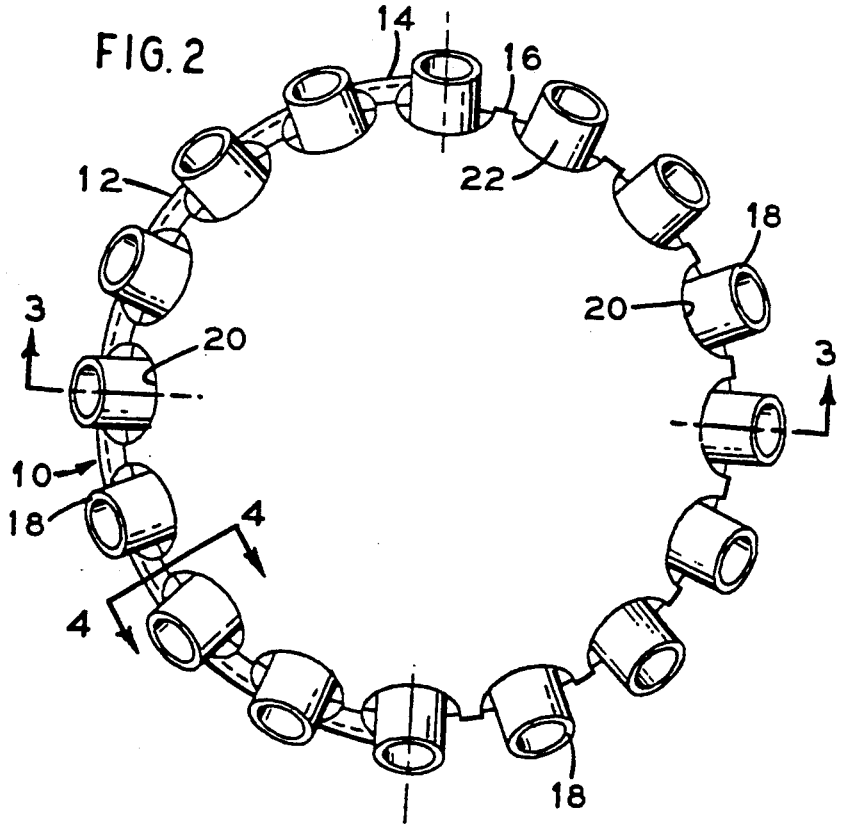
FIG. 2 is a plan view of the invention with a portion of the shield gas supply housing removed for clarity.

Referring initially to FIGS. 1-5, there is shown atomizer assembly 10 which incorporates atomizer head portion 12 surrounded by shield gas supply housing 14. Atomizer head portion 12 also incorporates spherical end cap 16 and various exit orifices 18 extending therefrom.

Figure 8:
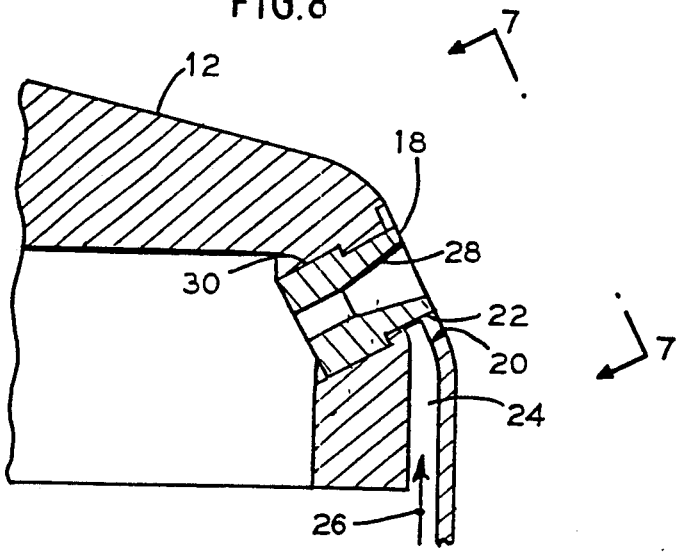
FIG. 8 is a view similar to that of FIG. 3 illustrating flush exit orifices.
Figure 9:
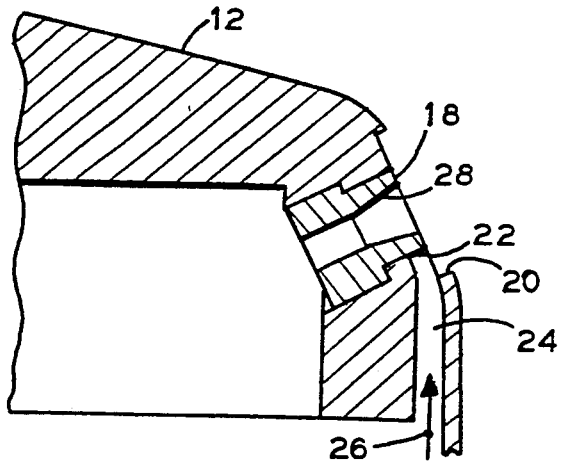
FIG. 9 is a view similar to that of FIG. 3 illustrating recessed exit orifices.

In accordance with this embodiment, the various exit orifices 18 are located in a circle around the central axis of end cap 16, but other arrangements of exit orifices 18 are equally likely (such as there being multiple rows of exit orifices 18 or orifices 18 being systematically spaced within spherical end cap 16). Additionally, while exit orifices 18 are shown as extending from end cap 16, they may also be flush with or recessed within end cap 16 (FIGS. 8 and 9). In any event, each exit orifice 18 is aligned with a respective opening 20 in end cap 16 with this opening 20 being sized slightly larger than the outside perimeter 22 of its respective exit orifice 18.

Figure 7:
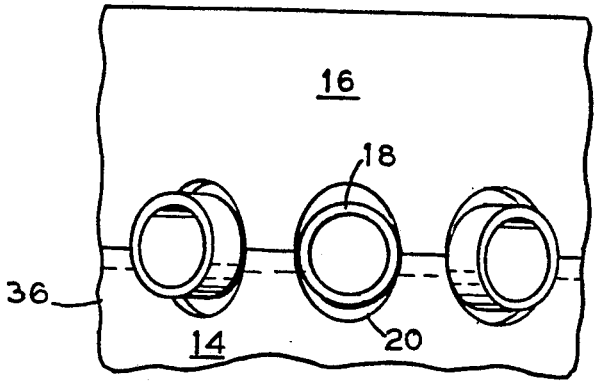
FIG. 7 is a view similar to that of FIG. 5 illustrating non-circular shield gas openings.

Openings 20 are preferably circular as shown, but they may also be non-circular if such is desired (FIG. 7).

Figure 3:
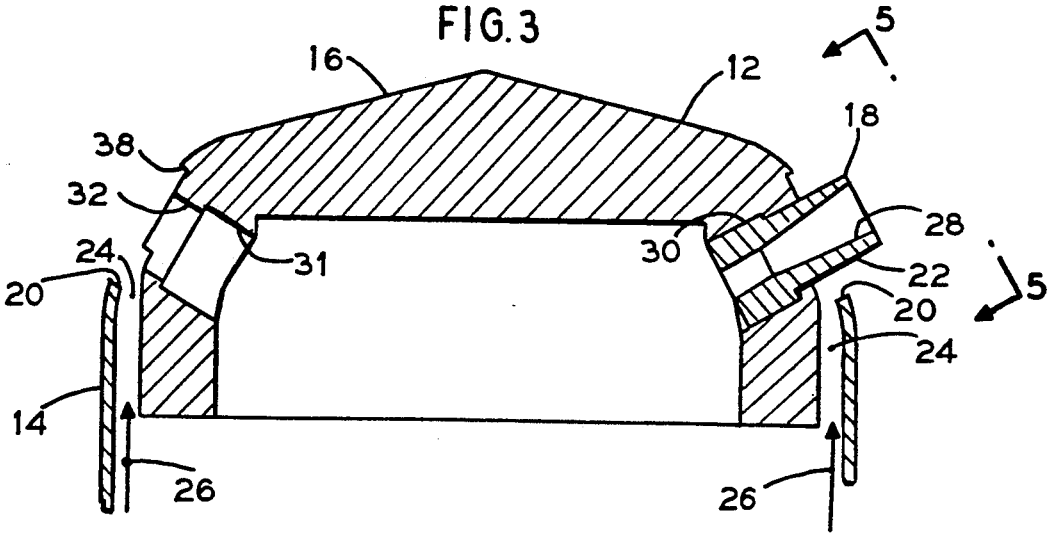
FIG. 3 is a sectional view taken along lines 3—3 of FIG. 2. with one of the exit orifices removed for clarity.

Referring now more specifically to FIG. 3, there is shown shield gas supply housing 14 which is slightly spaced from end cap 16. This gap between housing 14 and end cap 16 defines shield gas flow path 24 through which shield gas 26 travels before it exits atomizer 10. This shield gas 26 is discharged from atomizer 10 via openings 20 that both surround each individual exit orifice 18 (as discussed above) and which are in direct communication with shield gas flow path 24.

Also shown in FIG. 3, each exit orifice 18 is illustrated as being constructed with a specially designed interior flow configuration 28. The particular flow configuration 2 selected is a function of the viscosity and pressure of the material flowing therethrough. In this case, the flow configuration 28 is initially constricted so as to temporarily increase the pressure of the fuel or slurry afterwhich this flow configuration 28 generally becomes enlarged or tapers outward so that such pressure can be released thereby also atomizing the fuel or slurry.

Additionally, FIG. 3 illustrates each exit orifice 18 as being configured with an enlarged base portion 30 while passageway 31 in end cap 16 is configured with a reduced exit region 32. In this fashion, when exit orifice 18 is inserted within passageway 31 from the interior of end cap 16, enlarged base portion 30 engages reduced exit region 32 to prevent exit orifice 18 from sliding or coming out of end cap 16. Locking plate 34 (FIG. 6) is secured to the underside of end cap 16 and engages enlarged base portion 30 of each exit orifice 18 to securely retain each exit orifice 18 in place. As a result, each exit orifice 18 is wedged between reduced exit region 32 and locking plate 34 such that any pressure or temperature variation, or any vibration that may arise will not dislodge exit orifice 18. Generally, locking plate 34 also acts as a wear plate to further protect end cap 16 from undue erosion.

As can be seen, end region 36 of housing 14 is scalloped so as to accommodate the various exit orifices 18 and to conform to openings 20. Additionally, the perimeter of end cap 16 is likewise notched 38 in a manner matching scalloped end region 36. Notched area 38 is such that when housing 14 is installed on atomizer head 12, the respective notched and scallop areas are in alignment thereby forming openings 20 through which exit orifices 18 extend and through which shield gas 26 passes around each such exit orifice 18. In other embodiments, openings 20 may not be divided between end region 36 of housing 14 and the perimeter of end cap 16, in these other embodiments, openings 20 may fully be within end cap 16.

Figure 4:
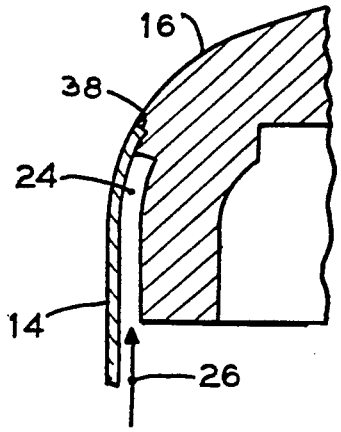
FIG. 4 is a sectional view taken along lines 4—4 of FIG. 2 illustrating the flow of shield gas between the end cap and the outer shield gas supply housing.
Figure 5:
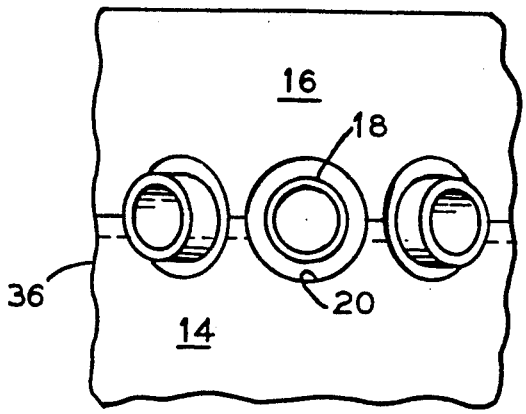
FIG. 5 is a sectional view taken along lines 5—5 of FIG. 3 partially cut away, illustrating the individual exit orifices of the atomizer head.

FIG. 4 discloses a view of atomizer head 12 wherein housing 14 and end cap 16 engage each other while still providing for shield gas flow path 24. Notch 38 in end cap 16 provides support for end region 36 of housing 14 while also permitting shield gas 26 to flow through flow path 24 and out openings 20. FIG. 5 illustrates the match or compatibility between notched area 38 and scalloped end region 36.

Figure 6:
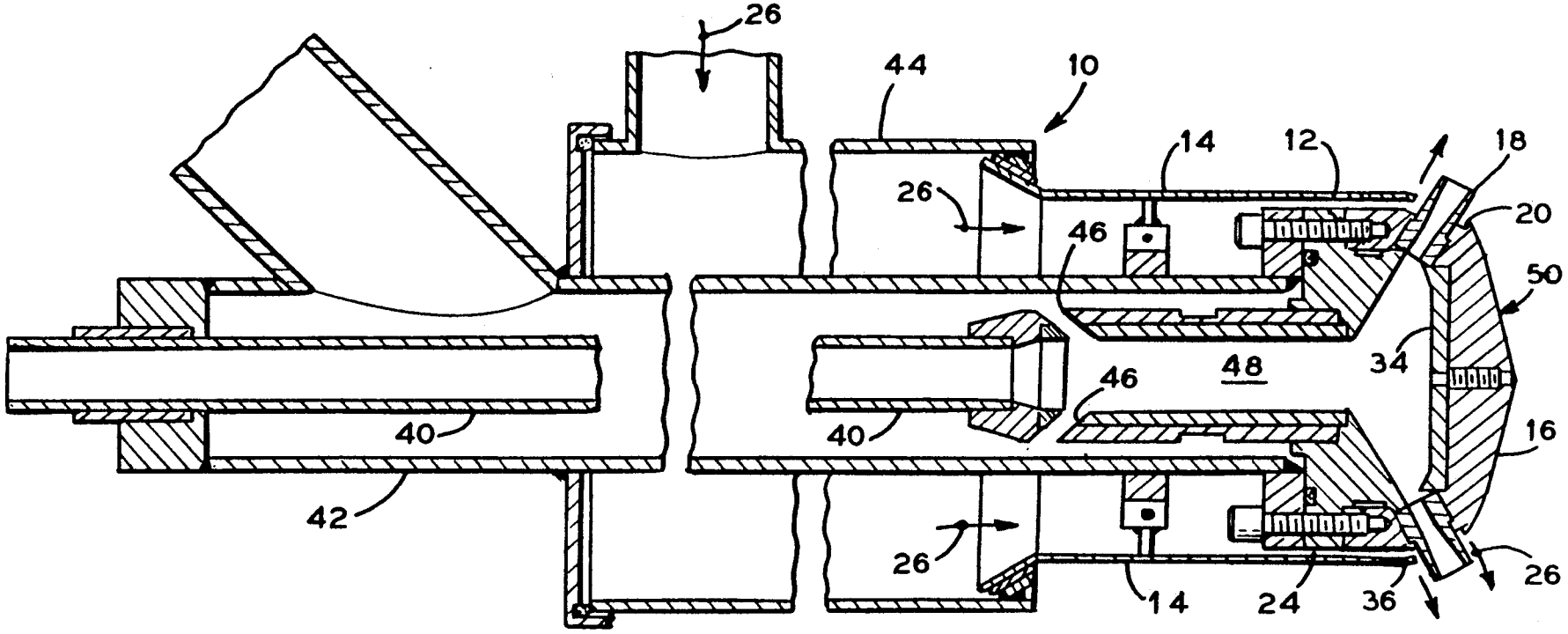
FIG. 6 is a sectional view of an atomizer assembly partially broken away.

FIG. 6 illustrates in greater detail atomizer assembly 10. As shown, atomizer assembly 10 is a dual fluid atomizer wherein a first fluid flows through inner conduit 40 and a second fluid flows through middle conduit 42. Shield gas 26 flows through outer conduit 44. The flow through all three conduits can be separately regulated for optimum control over their supply to the combustion chamber or the scrubber tower, however atomizer assembly 10 is utilized. As illustrated, atomizer assembly 10 provides for the inter-mixing of the first and second fluids prior to discharge via portals 46 just upstream end cap 16. In this fashion, it is possible to combine oil as the first fluid with steam or air as the second fluid in mixing chamber 48. Alternatively, liquid or slurry reagent and/or recycled by-products can be combined with supplemental additives in mixing chamber 48 in a flue gas desulfurization and/or contaminant removal process. Afterwards, the combined product (whether it be steam/oil or air/reagent and/or by-products/additives) will exit assembly 10 through exit orifices 18 which will be surrounded by shield gas 26.

For maintenance purposes, housing 14 is removable from atomizer assembly 10 through normal means, such as by unthreading or unbolting. Additionally, end cap assembly 50 may likewise be removed for repair or replacement or for access to exit orifices 18.

Alternative embodiments may incorporate only one conduit in place of both inner and outer conduits 40 and 42. Additionally, another embodiment may locate, orient, and secure exit orifices 18 differently, such as by incorporating exit orifices 18 at different angles for use near walls and the like. Likewise, exit orifices may be configured so as not to extend beyond housing 14, or by configuring them to be recessed below the surface of atomizer head portion 12. Furthermore, it may desirable to provide a non-annular flow path for shield gas 26 or openings 20 may be interconnected such that shield gas 26 is discharged in a continuous manner around end cap 16. Also, the means of mixing the first and second fluids may differ and the means of attaching end cap 16 and securing exit orifices 18 may vary.

What is claimed is:

1. An atomizer having an end cap assembly with a plurality of exit orifices therein and a shield gas supply housing spaced from the end cap assembly thereby defining a shield gas flow path therebetween, wherein the improvement comprises:

a) the end cap assembly being removable;

b) an individual shield gas opening surrounding each of the plurality of exit orifices with each said individual shield gas opening being in communication with the shield gas flow path whereby a shield gas is ejected from the atomizer fully surrounding each of the plurality of exit orifices; and c) each said shield gas opening is configured by the alignment of notches in the end cap assembly with a scalloped end region of the shield gas supply housing.

2. The apparatus as set forth in claim 1 wherein the exit orifices are symmetrically oriented around a central axis.

3. The apparatus as set forth in claim 1 wherein the exit orifices are constructed with a predetermined interior flow configuration.

4. The apparatus as set forth in claim 3 further comprising a locking plate secured to the end cap assembly for retaining the exit orifices in place, said locking plate also comprising a wear plate to minimize erosion within the end cap assembly.

5. The apparatus as set forth in claim 4 wherein said shield gas openings are circular.

6. The apparatus as set forth in claim 4 wherein said shield gas openings are non-circular.

7. The apparatus as set forth in claim 4 wherein the exit orifices extend outward away from the end cap assembly.

8. The apparatus as set forth in claim 4 wherein the exit orifices are flush with the end cap assembly.

9. The apparatus as set forth in claim 4 wherein the exit orifices are recessed within the end cap assembly.

* * * * *